US005590969A

United States Patent [19]

Nakayama et al.

[11] Patent Number: 5,590,969

[45] Date of Patent: Jan. 7, 1997

[54] WEAR-RESISTANT PROTECTIVE FILM FOR THERMAL PRINTING HEADS

[75] Inventors: Masatoshi Nakayama; Masahiro Nakano; Tsukimi Endo, all of Tokyo, Japan

[73] Assignee: TDK Corporation, Tokyo, Japan

[21] Appl. No.: 372,691

[22] Filed: Jan. 13, 1995

Related U.S. Application Data

[63] Continuation of Ser. No. 44,441, Apr. 6, 1993, abandoned.

[30] Foreign Application Priority Data

Sep. 28, 1992 [JP] Japan ..... 4-281079

[51] Int. Cl.[6] ..... B41J 2/335

[52] U.S. Cl. ..... 400/120.01; 347/171; 347/203

[58] Field of Search ..... 400/120.01; 347/171, 347/203, 201

[56] References Cited

U.S. PATENT DOCUMENTS

| | | | |
|---|---|---|---|
| 4,400,100 | 8/1983 | Aviram | 400/120 |
| 4,835,548 | 5/1989 | Nikadio | 400/120 |
| 4,862,195 | 8/1989 | Kato | 400/120 |
| 5,225,951 | 7/1993 | Kira et al. . | |

FOREIGN PATENT DOCUMENTS

| | | |
|---|---|---|
| 74177 | 5/1982 | Japan . |
| 118273 | 7/1983 | Japan . |
| 59-208261 | 10/1984 | Japan . |
| 202465 | 8/1989 | Japan . |
| 231154 | 9/1990 | Japan . |

*Primary Examiner*—John S. Hilten
*Attorney, Agent, or Firm*—Sprung Horn Kramer & Woods

[57] ABSTRACT

A wear-resistant protective film for thermal printing heads comprising Si, O, and N as principal constituent elements, contains additionally at least one alkaline earth metal selected from the group consisting of Be, Mg, Ca, Sr, Ba, and Ra. Preferably, the film has a composition $SiM_xO_yN_z$ in which M stands for an alkaline earth metal, x is 0.01–0.5, y is 0.1–2.0, and z is 0.2–1.8.

6 Claims, 1 Drawing Sheet

WEAR-RESISTANT PROTECTIVE FILM FOR THERMAL PRINTING HEADS

This application is a continuation, of application Ser. No. 08/044,441, filed Apr. 6, 1993, now abandoned.

BACKGROUND OF THE INVENTION

This invention relates to a wear-resistant protective film for thermal printing heads.

Thermal printing heads are in extensive use with computers, word processors, facsimiles, and other similar devices. The head comprises a matrix of many dot resistance heating elements of polysilicon or the like, which can be selectively heated with an electric current to print data by thermal transfer onto paper through a printing ribbon. Since the paper is carried in sliding contact with the head, the contacting surface of the dot resistance heating elements must be protected with a highly wear-resistant protective film.

Each dot printing element, as a spot, of a thermal printing head, as illustrated in FIG. 1, comprises, from the base upward, a substrate 1 of alumina or the like, glaze glass 2 for heat accumulation, a heating unit layer 3 of polysilicon or the like, electrodes 4, 5, and a wear-resistant protective film 6. The numeral 7 indicates a heating spot.

The protective film 6 generally is required to have high hardness, reduced internal stresses attributable to heat and the composition and structure of its own, good resistance to wear, and stability against moisture, alkalies and other corrosive attacks. Diverse materials have hitherto been studied as candidates to meet these requirements.

Among the wear-resistant protective films of the prior art, those of the Si-O-N system introduced by Japanese Patent Application Public Disclosure Nos. 74177/1982 and 118273/1983 have great hardness and are superior in abrasion resistance, environmental resistance, and other properties required of thermal printing heads. Their disadvantages are the tendencies of cracking and separation from the base surface due to much internal stresses.

As noted above, the wear-resistant protective films of the Si-O-N system for thermal printing heads have the disadvantages of easily cracking and separating from the base under the influence of the internal stresses, in contrast with their otherwise superior properties as such. The present invention aims at overcoming those disadvantages of the wear-resistant protective films of the Si-O-N system for thermal heads.

SUMMARY OF THE INVENTION

The present invention provides a wear-resistant protective film for thermal printing heads comprising Si, O, and N as principal constituent elements, characterized in that it further contains at least one alkaline earth metal selected from the group consisting of Be, Mg, Ca, Sr, Ba, and Ra. Preferably, the wear-resistant protective film has a composition $SiM_xO_yN_z$ in which M stands for an alkaline earth metal, x is 0.01–0.5, y is 0.1–2.0, and z is 0.2–1.8.

DETAILED DESCRIPTION OF THE INVENTION

Figure 1:
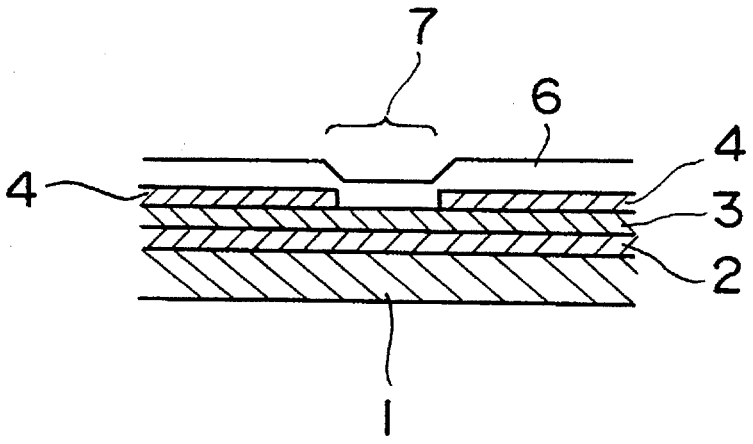
FIG. 1 is a fragmentary sectional view showing the basic structure of a thermal printing head.

The wear-resistant protective film of the invention for thermal printing heads is an excellent protective film in which not merely the high hardness and abrasion resistance that characterize the Si-O-N system are enhanced but also the internal stresses are reduced, whereby improvements in both adhesion and crack resistance are attained.

The wear-resistant protective film according to the invention is of a Si-M-O-N system in which M is as defined above, preferably of a material composition $SiM_xO_yN_z$ in which M, x, y, and z are as already defined. Here the range of 0.01–0.5 has been chosen for x because an amount down to the lower limit is necessary to reduce the internal stresses but an amount not exceeding the upper limit is required to prevent the reduction of the hardness and abrasion resistance of the Si-O-N system. The ranges of y=0.1–2.0 and z=0.2–1.8 have been chosen in consideration of the hardness and abrasion resistance, and also taking the reduction of internal stresses into account.

Both O and N increase hardness and abrasion resistance. If they are insufficient the resulting film will soften and have inadequate abrasion resistance. If excessive, they will embrittle the film. The combined amount being the same, the larger the O proportion and the smaller the N the greater will be the crack resistance or, conversely, the larger the N proportion and the smaller the O the higher will be the abrasion resistance. In view of these, the ranges for x, y, and z have been fixed as specified so as to balance the total amount and the proportion of the individual components.

The protective film of the invention may be formed, e.g., by sputtering. In that case, $SiO_2$, MO, $Si_3N_4$ and the like are used as film-forming materials. They are mixed in a predetermined mixing ratio, the mixture is press-molded to form a target, and the target is subjected to Ar sputtering with the application of an rf current, using Ar gas as the atmosphere gas, with the further addition of $O_2$ and $N_2$ gases where necessary. An Si-M-O-N protective film is thus formed on a base, e.g., an alumina substrate, precoated with a glass glaze layer.

EXAMPLE 1

Powders of $SiO_2$, $Si_3N_4$, and MgO were mixed in a molar ratio of 4:5:1. The mixture was press-molded to a target, which then was rf-sputtered with an electric power of 1.5 kW and at an Ar pressure of 3 Pa and a substrate temperature of 350° C. to form a film 4.5 μm thick as a wear-resistant layer. The composition was adjusted by reactive sputtering with proper addition of $O_2$ and $N_2$ to the Ar gas. The resulting composition was $SiMg_{0.05}O_{0.5}N_{0.98}$.

The Si-Mg-O-N film thus obtained was subjected to various tests and measurements. Its scratch resistance was determined by a scratch tester (Model "HEIDON-14" manufactured by Shintoh Kagaku Co.) using a diamond stylus.

EXAMPLE 2

Powdered $SiO_2$, $Si_3N_4$, and SrO in a molar ratio of 4:4:2 were mixed up and, by the same procedure as used in Example 1, an Si-Sr-O-N film was formed as a wear-resistant layer. The resulting composition was $SiSr_{0.12}O_{0.63}N_{0.95}$.

The Si-Sr-O-N film was tested and measured by various methods.

EXAMPLE 3

An Si-Ba-O-N film was made as a wear-resistant layer from powdered $SiO_2$, $Si_3N_4$, and BaO mixed in a molar ratio of 3:5.5:1.5, in the manner described in Example 1. The final composition was $SiBa_{0.08O0.39}N_{1.1}$.

The Si-Ba-O-N film was variously tested and measured.

EXAMPLE 4

Powdered $SiO_2$, $Si_3N_4$, MgO, and SrO were mixed in a molar ratio of 4:5:0.5:0.5 and formed, by following the procedure of Example 1, into an Si-Sr-O-N film as a wear-resistant layer. The composition thus obtained was $SiMg_{0.023}Sr_{0.026}O_{0.48}N_{0.96}$.

The Si-Mg-Sr-O-N film was subjected to various tests and measurements.

EXAMPLE 5

Powders of $SiO_2$, $Si_3N_4$, CaO, and Bao in a molar ratio of 4:4:1:1 were mixed up and formed into an Si-Ba-O-N film in the manner described in Example 1. The resulting composition was $SiCa_{0.05}Ba_{0.06}O_{0.62}N_{0.97}$.

The Si-Ca-Ba-O-N film was tested and measured in various ways.

COMPARATIVE EXAMPLE 1

Powdered $SiO_2$ and $Si_3N_4$ were mixed in a molar ratio of 5:5 and, in a procedure similar to that of Example 1, the mixture was formed into an Si-O-N film as a wear-resistant layer.

The Si-O-N film was variously tested and measured.

The results of the tests and measurements of the wear-resistant layers formed in Examples 1 to 5 and Comparative Example 1 are given in Table 1.

TABLE 1

| | Internal stress, dyne/cm$^2$ | Scratch resistance, g | Vickers hardness, kg/mm$^2$ |
|---|---|---|---|
| Example | | | |
| 1 | $8.5 \times 10^8$ | 800 | 1600 |
| 2 | $8.0 \times 10^8$ | 850 | 1500 |
| 3 | $9.0 \times 10^8$ | 700 | 1550 |
| 4 | $8.1 \times 10^8$ | 910 | 1650 |
| 5 | $7.5 \times 10^8$ | 930 | 1540 |
| Comp. Ex. 1 | $5.0 \times 10^9$ | 190 | 1300 |

As will be understood from the foregoing examples, the wear-resistant protective film for thermal printing heads according to the present invention is harder and is more scratch-resistant than conventional Si-O-N protective films. This is presumably attributable to enhanced adhesion on account of the addition of an alkaline earth metal. In addition, the internal stresses decrease by one order of magnitude. The latter brings an outstanding functional effect of minimizing the possibility of cracking.

What is claimed is:

1. A wear-resistant protective film for a thermal printing head, said film comprising Si, O, N and at least one element selected from the group consisting of Sr, Ba and Ra.

2. The wear-resistant protective film of claim 1, which comprises a composition $SiM_xO_yN_z$, wherein M stands for at least one element selected from the group consisting of Sr, Ba and Ra, x is 0.01 to 0.5, y is 0.1 to 2.0, and z is 2.0 to 1.8.

3. The wear-resistant protective film of claim 2, having an internal stress of less than $1\times10^9$ dyne/cm$^2$.

4. A thermal printing head having a wear-resistant protective film thereon, said film comprising Si, O, N and at least one element selected from the group consisting of Sr, Ba and Ra.

5. The thermal printing head of claim 4, wherein said wear-resistant protective film comprises a composition $SiM_xO_yN_z$, wherein M stands for at least one element selected from the group consisting of Sr, Ba and Ra, x is 0.01 to 0.5, y is 0.1 to 2.0, and z is 2.0 to 1.8.

6. The thermal printing head of claim 5, wherein said wear-resistant protective film has an internal stress of less than $1\times10^9$ dyne/cm$^2$.

* * * * *